US005884905A

United States Patent [19]

Keindl

[11] Patent Number: 5,884,905

[45] Date of Patent: Mar. 23, 1999

[54] FRAME-CLAMPING DEVICE

[76] Inventor: Werner Keindl, Hagrainerstrasse 8, D-84036 Landshut, Germany

[21] Appl. No.: 66,727

[22] Filed: Apr. 24, 1998

[30] Foreign Application Priority Data

Apr. 25, 1997 [DE] Germany ..... 297 07 426 U

[51] Int. Cl.[6] ..... B25B 1/20

[52] U.S. Cl. ..... 269/41; 269/236; 269/208; 269/235

[58] Field of Search ..... 269/41, 42, 71, 269/236, 235, 211, 208

[56] References Cited

U.S. PATENT DOCUMENTS 1,259,750 3/1918 Kaiser ..... 269/236
1,643,838 9/1927 Corbin ..... 269/236
1,850,695 3/1932 Scott ..... 269/42
4,247,090 1/1981 Hahn et al. ..... 269/41

*Primary Examiner*—Robert C. Watson
*Attorney, Agent, or Firm*—Cohen, Pontani, Lieberman & Pavane

[57] ABSTRACT

A device for clamping two bevel-cut strips (24) so that they may be joined to each other comprises slides (20) for clamping the strips (24) and a displacement member (36). The slides (20) are L-shaped in cross-section, are displaceable at right angles to each other and are located in guides (34) mounted on a base plate (10). Each slide (20) is associated with a displaceable clamping member (46) which engages the respective strip (24). The guide (34) of each slide (20) has sufficient play in the vertical direction so that the vertical position of the slide (20) on the base plate (10) can be adjusted before the strips are joined (24).

11 Claims, 2 Drawing Sheets

FRAME-CLAMPING DEVICE

The invention relates to a device for clamping two bevel-cut strips to be joined to each other comprising slides for clamping the strips, the slides being L-shaped in cross-section and displaceable at right angles to each other in guides mounted on a base plate, each slide being associated with a displaceable clamping member engaging in use, the respective strip, and with a displacement member.

Devices of this type are generally used for clamping strips for picture frames which have to be glued together at their mitred faces. A device of the type defined in the introduction is known for example from DE 20 43 586. In this clamping device the two slides are mounted mutually displaceably in guides which are not shown in detail but which are evidently dovetail guides or the like and are without play vertically. The quick-acting clamping members comprise screw clamps which are pivotable about vertical axes and which act upon the top of the respective strip. In this way, flat strips can be clamped only on their top.

The subject of DE 40 05 043 is a mitre-clamping device, in which two strips are pressed against each other with the aid of a screw clamp, without guides being provided for positioning the strips in a precise and error-free manner.

A device for mutually clamping components to be joined to each other in pairs at mitred faces is described and illustrated in DE 41 19 049. This device essentially comprises two component holders which can be displaced towards each other by a threaded spindle and between which an adjustment member is pivotably mounted which is intended to ensure that the strips are precisely positioned with respect to each other before they are displaced towards each other in synchronism by means of the threaded spindle.

Finally, it is known from DE 187 975 to insert two strips for picture frames to be glued together in a fixed angle guide and to clamp them securely there with the aid of eccentric discs with a serrated profile.

An object of the invention is to provide a frame-clamping device which makes it possible for the two strips which are to be joined to each other to be precisely positioned at the mitre and allows corrections to be made manually with simple means before the final joining.

The invention provides a device as claimed in claim 1.

Since the two slides on the base plate are not mounted in fixed slides, but can be lifted by hand at any point by an amount corresponding to the play, it is possible to make vertical corrections at the last moment before the two mitred faces which are to be glued or secured by adhesion come into contact.

In a preferred embodiment the guide for each slide comprises preferably three pins which form a triangle and which are screwed into the underside of the slide and each of which engages in an elongate hole in the base plate and rests with its head below the underside of the base plate at a distance determining the play.

In this case it is advantageous if a spacer sleeve supported at both ends on respective stop discs is positioned on each pin. The desired degree of play can thus be increased or reduced by simply changing the spacer sleeve.

In a further preferred embodiment of the invention each clamping member comprises an eccentric disc having a cylindrical pin projecting from the underside thereof for insertion into a receiving bore in the respective slide, the outer edge of the eccentric disc having positively locking clamping means for holding the respective strip resting, in use, against the upright of the L-arm of the slide. The positively locking clamping means may have a serrated profile on its outer edge or, on the other hand, an outer-edge coating of resilient material, preferably plastics material. The plastics-material coating has the advantage over the serrated profile that strips can be gripped even at sensitive areas where a serrated profile would cause damage.

In a further embodiment of the invention the receiving bores for the cylindrical pins projecting from the underside of each eccentric disc have a low-friction coating of wear-resistant material. This coating can consist of a laminated fabric, preferably glass or paper laminated fabric. In contrast to conventional brass sleeves which are inserted into the receiving bores to reduce friction, this coating has the advantage that no abrasion occurs which soils the slide. This abrasion is particularly disadvantageous when gluing strips for picture frames.

In another embodiment of the invention the upright of the L-arm of each slide has a horizontal projection formed thereon which acts as a stop for the displacement member, the stop being a manually actuated adjusting spindle rotatably mounted in a thread on a guide block which is attached to the base plate. The two slides are thus displaced independently of each other, so that, in contrast to forcible guides with an adjusting spindle which acts upon both the slides, corrections can be made by hand at any time before the strips are finally joined at their mitred faces.

The invention is explained below with reference to an embodiment which is illustrated in the drawing, in which FIG. 1 is a plan view of a device according to the invention;

Figure 1:
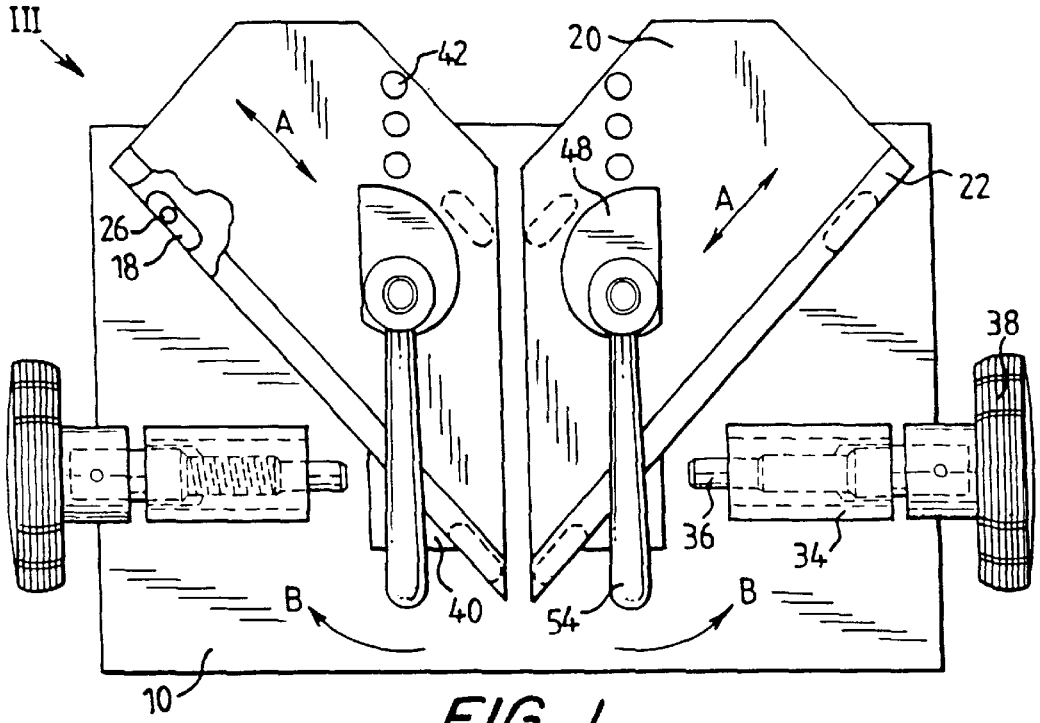
Figure 2:
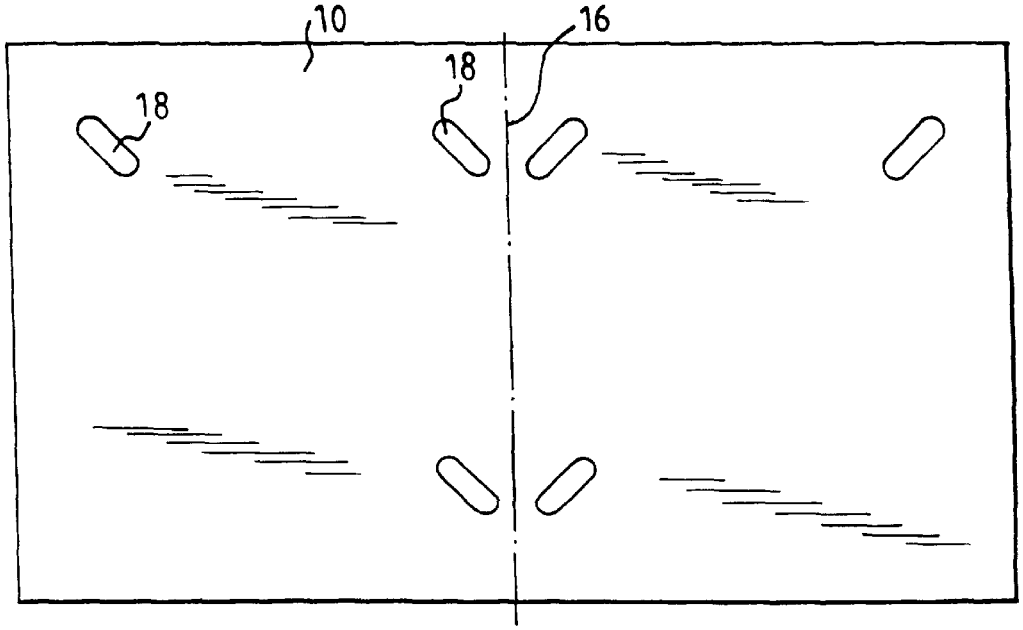
FIG. 2 is a plan view of the base plate of the device.
Figure 3:
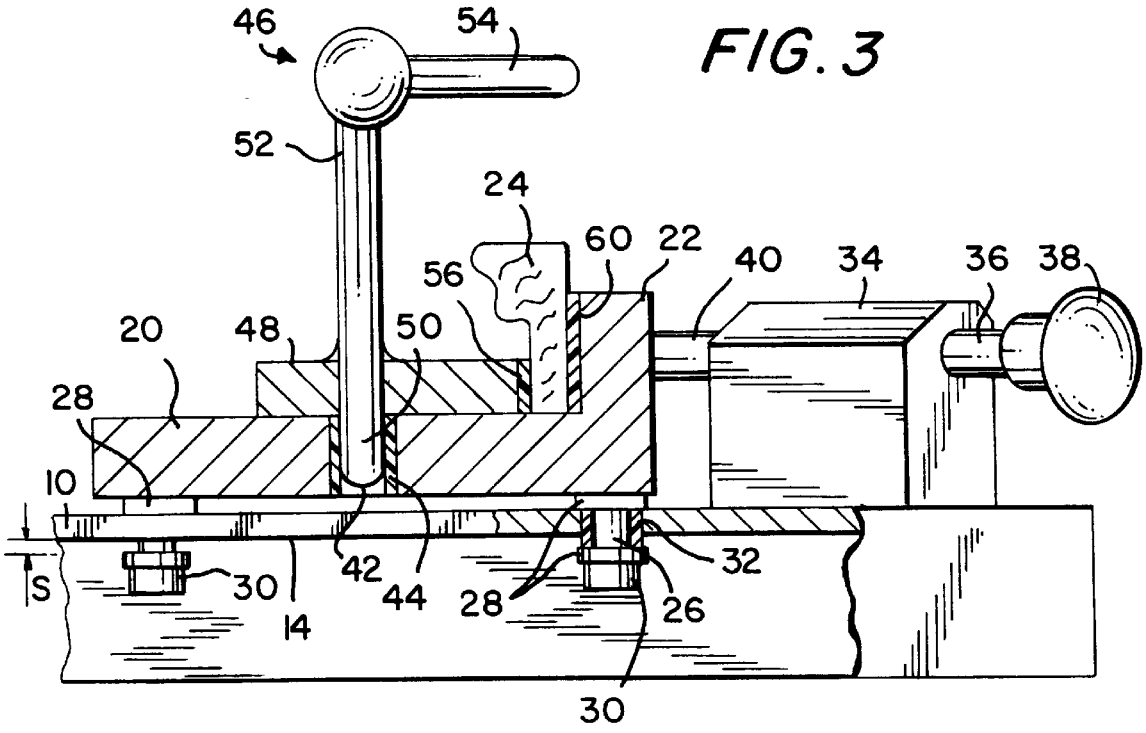
FIG. 3 is a view, partly in section, in the direction of arrow III in FIG. 1.

FIGS. 1 to 3 show a rectangular base plate 10 of sheet metal, the edges 12 of which are angled downwards, so that the base plate 10 rests with the underside 14 thereof freely above a workbench or the like. As shown in particular in FIG. 2, three respective elongate holes 18, which form a triangle and which extend parallel to one another on each side of the median axis 16 and at a right angle to one another with respect to the elongate holes on the respective other side of the median axis 16, are formed in the base plate 10 symmetrically to the median axis 16. The elongate holes 18 are part of a guide for two slides 20 which are L-shaped in cross-section (cf. FIG. 3) and likewise consist of metal. As shown in FIG. 1, the two L-arms 22 projecting upwards from each slide 20 extend at a right angle to each other and each act as an abutment of a respective strip 24, for example a strip of wood for producing a picture frame. The two strips 24 clamped onto the slides 20 are glued together at their mitred faces on the device, this being described in greater detail below.

FIG. 3 shows that a pin 26, which is screwed by a thread (not shown in detail) into a threaded .bore in the slide 20, projects from the underside of each slide 20. In this case, the three pins 26 of each slide 20 are positioned in such a way that they likewise form a triangle and engage through the elongate holes 18 in the base plate 10. Two stop discs 28, which rest respectively on the top of the base plate 10 and below the underside 14 thereof on the head 30 of the pin 26, are mounted on each pin 26. A spacer sleeve 32 of plastics material, which when required can be exchanged for a spacer sleeve 32 of different length by unscrewing the pin 26, is mounted between the two stop discs 28 on the pin 26.

The length of the spacer sleeve 32 defines a vertical degree of play s, which allows the slide 20 to be re-set in order to adjust the position thereof above the base plate 10. The play s can be in the order of magnitude of between 1 and 4 mm.

Two guide blocks 34 are secured to the base plate 10 symmetrically to its median axis 16. One respective adjusting spindle 36, which can be adjusted in the longitudinal direction by means of a handle 38 in the thread of the guide block 34, is mounted rotatably in each of the said guide blocks 34. The free end of each adjusting spindle 36 projecting out of the guide block 34 comes to rest against a projection 40 which projects horizontally from the opposite arm 22 of the slide 20. With the aid of the steps described, the two slides 20 can be adjusted at a right angle to each other on the base base 10 and independently of each other in the direction of the double arrows A indicated in FIG. 1.

FIG. 1 shows that a row of receiving bores 42 are formed in each slide 20 in such a way that the two rows extend parallel to each other and at right angles to the two adjusting spindles 36. As shown in FIG. 3, each receiving bore 42 has a low-friction coating 44 of wear-resistant material, preferably glass or paper laminated fabric. The receiving bores 42 are used for positioning a clamping member 46 on each of the two slides 20 in accordance with the width of the strip 24 to be clamped. In this case, the clamping member 46 comprises an eccentric disc 48, from the underside of which a cylindrical pin 50 projects which is inserted into the selected receiving bore 42 substantially without play. The cylindrical pin 50 is extended beyond the top of the eccentric disc 48 to form a pin 52 which is securely connected to the eccentric disc 48 and from the upper end of which a handle 54 projects vertically.

Figure 5:
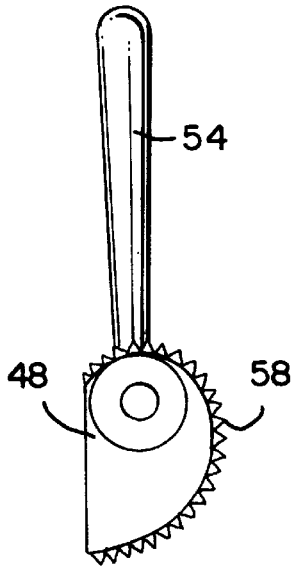
FIG. 5 is a variant of FIG. 4, in which the outer edge of the eccentric disc has a serrated profile.
Figure 4:
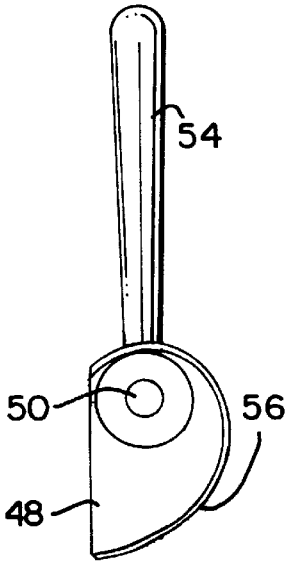
FIG. 4 is a view from below of a clamping member with a resilient coating of the outer edge of the eccentric disc.

In a preferred embodiment of the invention which is illustrated in FIGS. 3 and 4, each eccentric disc 48 is provided on the outer edge thereof with a coating 56 of a resilient material, preferably plastics material. In the variant illustrated in FIG. 5, the outer edge of the eccentric disc 48 has a serrated profile 58.

The device according to the invention is used in the following manner:

Two strips 24, which are to be joined to each other and which are coated with glue or adhesive on their mitred faces, are placed on each slide 20 in such a way, as shown in FIG. 3, that they rest against the vertical arm 22 of the slide 20, optionally with the interposition of a band 60 of cardboard or the like which protects the surface of the strip 24. In this case the ends of the two strips 24 to be joined together project slightly beyond the respective slide 20; in this position the two strips 24 are pressed and firmly clamped against the vertical arm 22 of the slide 20 with the aid of the eccentric discs 48. For this purpose, the two eccentric discs 48 are rotated by way of their handle 54 in the direction of the arrows B indicated in FIG. 1, until a positively locking connexion is produced between the outer edge of the eccentric disc 48 and the opposite side of the strip 24. The two slides 20 are then displaced at a right angle to each other in their guides in accordance with the double arrows A until the strips 24 touch each other on the mitres thereof.

Before a pressure is exerted by way of the two adjusting spindles 36 upon the mitres to be glued, it is possible to perform a fine adjustment of the two strips 24 with respect to each other, namely both by re-setting one of the two slides 20 in the direction of the arrows A and by manually lifting the slide 20 within the range of the vertical play s, so that the gluing at the corner which is formed by the two strips 24 no longer leaves any cutting faces exposed.

I claim:

1. A device for clamping two bevel-cut strips to be joined to each other comprising slides for clamping the strips, the slides being L-shaped in cross-section and displaceable at right angles to each other by means of guides mounted on a base plate, each slide having a displaceable clamping member engaging, in use, the respective strip, a displacement member and vertical displacement means, wherein the guide of each slide has sufficient play in the vertical direction to allow adjustment of the vertical position of the slide on the base plate before the strips are joined.

2. A device according to claim 1, wherein the guide for each slide comprises three pins fastened to the underside of the slide and forming a triangle, each pin engaging in a respective elongate hole in the base plate and resting with its head below the underside of the base plate at a distance determining the vertical play.

3. A device according to claim 2, wherein a spacer sleeve supported at both ends on respective stop discs is positioned on each pin.

4. A device according to claim 1, wherein each displaceable clamping member comprises an eccentric disc having a cylindrical pin projecting from the underside thereof for insertion into a receiving bore in the respective slide and the outer edge of the eccentric disc has positively locking clamping means for holding the respective strip.

5. A device according to claim 4, wherein the positively locking clamping means has an outer-edge coating of resilient material.

6. A device according to claim 5, wherein the resilient material is plastic material.

7. A device according to claim 4, wherein the outer edge of the positively locking clamping means has a serrated profile.

8. A device according to claim 4 wherein a receiving bore for the cylindrical pin projecting from the underside of each eccentric disc has a low-friction coating of wear-resistant material.

9. A device according to claim 8, wherein the low-friction coating consists of a laminated fabric.

10. A device according to claim 9, wherein the laminated fabric is selected from the group consisting of glass and paper laminated fabric.

11. A device according to claim 1, wherein the vertical section of each L-shaped slide comprises a horizontal projection acting as a stop for the displacement member, the displacement member including a manually actuated adjusting spindle rotatably mounted in a thread on a guide block attached to the base plate.

* * * * *